US005119773A

United States Patent [19]

Schön et al.

[11] Patent Number: 5,119,773

[45] Date of Patent: Jun. 9, 1992

[54] APPARATUS FOR OPERATING THE VALVES ON INTERNAL COMBUSTION ENGINES WITH A VARIABLE VALVE LIFT CURVE

[75] Inventors: Helmut Schön, Karlsruhe; Peter Kuhn, Prankelstrasse 61, D-6940 Weinheim, both of Fed. Rep. of Germany

[73] Assignee: Peter Kuhn, Weinheim, Fed. Rep. of Germany

[21] Appl. No.: 466,443

[22] PCT Filed: Sep. 28, 1989

[86] PCT No.: PCT/EP89/01140

§ 371 Date: May 16, 1990

§ 102(e) Date: May 16, 1990

[87] PCT Pub. No.: WO90/03497

PCT Pub. Date: Apr. 5, 1990

[30] Foreign Application Priority Data

Oct. 1, 1988 [DE] Fed. Rep. of Germany ..... 3833540

[51] Int. Cl.[5] ..... F01L 1/12; F01L 1/18; F01L 1/22

[52] U.S. Cl. ..... 123/90.16

[58] Field of Search ..... 123/90.15, 90.16, 90.17

[56] References Cited

U.S. PATENT DOCUMENTS

| | | | |
|---|---|---|---|
| 4,138,973 | 2/1979 | Luria | 123/90.16 |
| 4,526,142 | 7/1985 | Hara et al. | 123/90.16 |
| 4,572,118 | 2/1986 | Baguena | 123/90.16 |
| 4,651,684 | 3/1987 | Masuda et al. | 123/90.16 |
| 4,714,057 | 12/1987 | Wichart | 123/90.15 |
| 4,724,822 | 2/1988 | Bonvallet | 123/90.16 |
| 4,911,124 | 3/1990 | Bennett | 123/90.16 |

FOREIGN PATENT DOCUMENTS

| | | | |
|---|---|---|---|
| 0044713 | 3/1982 | Japan | 123/90.16 |
| 0168207 | 9/1984 | Japan | 123/90.16 |
| 0228717 | 11/1985 | Japan | 123/90.16 |
| 02301 | 7/1983 | PCT Int'l Appl. . | |

*Primary Examiner*—E. Rollins Cross
*Assistant Examiner*—Weilun Lo
*Attorney, Agent, or Firm*—Antonelli, Terry Stout & Kraus

[57] ABSTRACT

An apparatus for operating the valves on internal combustion engines with a variable valve lift curve has a multimember, rotary gear, which comprises the valve-guiding case, a rotary cam connected to the case via a pivot joint and whose drive is derived from the crankshaft, an intermediate member operated by the cam by a curve joint and a driven member, which is supported by a joint on the case and operatively connected to the intermediate member via a joint and which transfers the movement to the valve. The intermediate member is supported by a curve joint on the case, with the curve of the curve joint, located on the intermediate member, having a portion forming a locking device and also a control portion. The position of the curve supported on the case and associated with this curve joint or the position of the pivot joint of the cam is adjustable during operation.

22 Claims, 4 Drawing Sheets

APPARATUS FOR OPERATING THE VALVES ON INTERNAL COMBUSTION ENGINES WITH A VARIABLE VALVE LIFT CURVE

FIELD OF THE INVENTION

The invention relates to an apparatus for operating the valves on internal combustion engines with the variable valve lift curve with a multimember, rotatable gear comprising the valve-guiding case, a rotating cam, driven by a crankshaft, connected to the case by a pivot joint, an intermediate member operated by the cam by a curve joint and a driven member, supported by a joint on the case and operatively connected to the intermediate member by a joint for transferring the movement to the valve.

BACKGROUND OF THE INVENTION

In order to reduce the load-dependent throttle losses on internal combustion engines, it is known to modify the valve opening times and valve lift curves during operation. In order to permit this modification, inter alia, multimember regulating or control gears are known (DE-A-27 53 197, DE-A-27 47 884, DE-A-30 06 619 and GB-A- 21 00 344). The known multimember gears suffer from the disadvantage of having a high constructional expenditure and a large space requirement and they generally constitute expensive constructions. In addition, in many cases, there is also a lack of rigidity due to the large number of members and joints and, in particular, their reciprocal construction and arrangement, so that it is frequently impossible to use them in rapidly rotating engines.

SUMMARY OF THE INVENTION

The aim underlying the invention resides in providing an apparatus of the aforementioned type which is inexpensive to manufacture and has a relatively small size and provides the necessary rigidity.

In accordance with the present invention, the intermediate member is supported by a curve joint on the case, with the curve of said curve joint, arranged on the intermediate member, having a portion forming a locking device and a control portion. A position of the curve supported on the case and belonging to the curve joint or the position of the pivot joint of the cam can be adjusted during operation.

In operation, the apparatus according to the invention only has three moving parts, namely, the rotary cam, the intermediate member and the driven member. Importance is attached to the adjustable curve joint with which the intermediate member is supported on the case, or the adjustable pivot joint of the cam for controlling the valve opening times, or the valve lift. These are determined by the curve located on the intermediate member as a part of the curve joint supporting said intermediate member, with the curve having a locking device for the load-free area and a controlled portion.

In a preferred embodiment, the curve of the curve joint supported on the case and which cooperates with the curve on the intermediate member is formed by a cylindrical surface. In the simplest case, it can be a cylindrical bolt, a roll, etc.

According to the invention, the joint is constructed between the intermediate member and the driven member and between the latter and the case as the pivot joint on each occasion.

The aforementioned embodiment is characterized by a particularly great rigidity and by a limited clearance and, as a result of its two pivot joints, constitutes a particular wear-resistant arrangement, which is especially suitable for rapidly rotating engines.

In accordance with features of the invention, the joint between the intermediate member and the driven member is constructed as a pivot joint and the joint between the driven member as a slider joint.

In this embodiment, the pivot joint between the intermediate member and the driven member is preferably formed by circular sliding faces, while the slider joint between the driven member and the case can be realized by the driven member being guided in a linearly displaceable manner in the case.

In the two aforementioned embodiments, the construction is advantageously such that the curve portion arranged on the intermediate member and forming the locking device (for the load-free area) is formed by an arc, whose center coincides with the pivot center of the pivot joint between the intermediate member and the driven member.

The aforementioned embodiment provides the possibility of making the curve supported on the case adjustable in such a way that its contact point with the curve portion on the intermediate member moves on an arc with the pivot center of the pivot joint between the intermediate member and the driven member in the form of a center. In the simplest case the construction can be such that the curve is supported on the case on an arc with the pivot center of the pivot joint is adjustable as a center between the intermediate member and the driven member.

In the aforementioned embodiment, the movement necessary for the control is in the form of a rotary movement, which can be easily realized from the constructional standpoint.

Another embodiment of the invention is characterized in that the joint between the intermediate member and the driven member is constructed as a slider joint and the joint between the driven member and the case is constructed as a pivot joint.

In the last mentioned embodiment, the slider joint between the driven member and the intermediate member is a sliding surface, while the driven member is supported on the case by means of a constructionally simple pivot joint.

In a modified embodiment, the joint between the intermediate member and the driven member and between the latter and the case is, in each case, constructed as a slider joint.

Thus, there are slider joints in the form of sliding surfaces between the intermediate member and the driven member and between the latter and the case. Such a construction is mainly suitable for slowly rotating engines, while also having the advantage of small size.

In the two aforementioned embodiments, it is possible to construct the curve portion forming the locking device (for the load-free area) positioned on the intermediate member as a plane, which is parallel to the plane of the slider joint between the intermediate member and the driven member.

The curve supported on the case is preferably adjustable in such a way that at its contact point with the curve portion on the intermediate member it is parallel to the plane of the slider joint and in the simplest form the curve is itself adjustable in this way.

All the embodiments of the invention give the possibility of constructing the intermediate member in a substantially triangular manner, whose one side forms part of the curve joint with the cam, whose second side forms part of the curve joint with the case and whose third side forms part of the pivot joint or slider joint with the driven member. This more particularly reveals the compact construction with low constructional expenditure and short control paths.

Finally, when the driven member is supported on a case by a pivot joint, the driven member can be constructed as a lever, e.g. as a drag or rocking lever, whereas, in the case where it is supported on the case by slider joints, it can, for example, be constructed as a cup tappet engageable over the valve stem at the end thereof.

According to a further embodiment, construction is advantageously such that there is a device for the automatic compensation of the valve clearance on one of the gear members or between the driven member and the valve stem.

BRIEF DESCRIPTION OF THE DRAWINGS

The above and other objects, features and advantages of the present invention will become more apparent from the following description when taken in connection with the accompanying drawings which show, for the purpose of illustration only, several embodiments in accordance with the present invention, and wherein.

DETAILED DESCRIPTION

Figure 1:
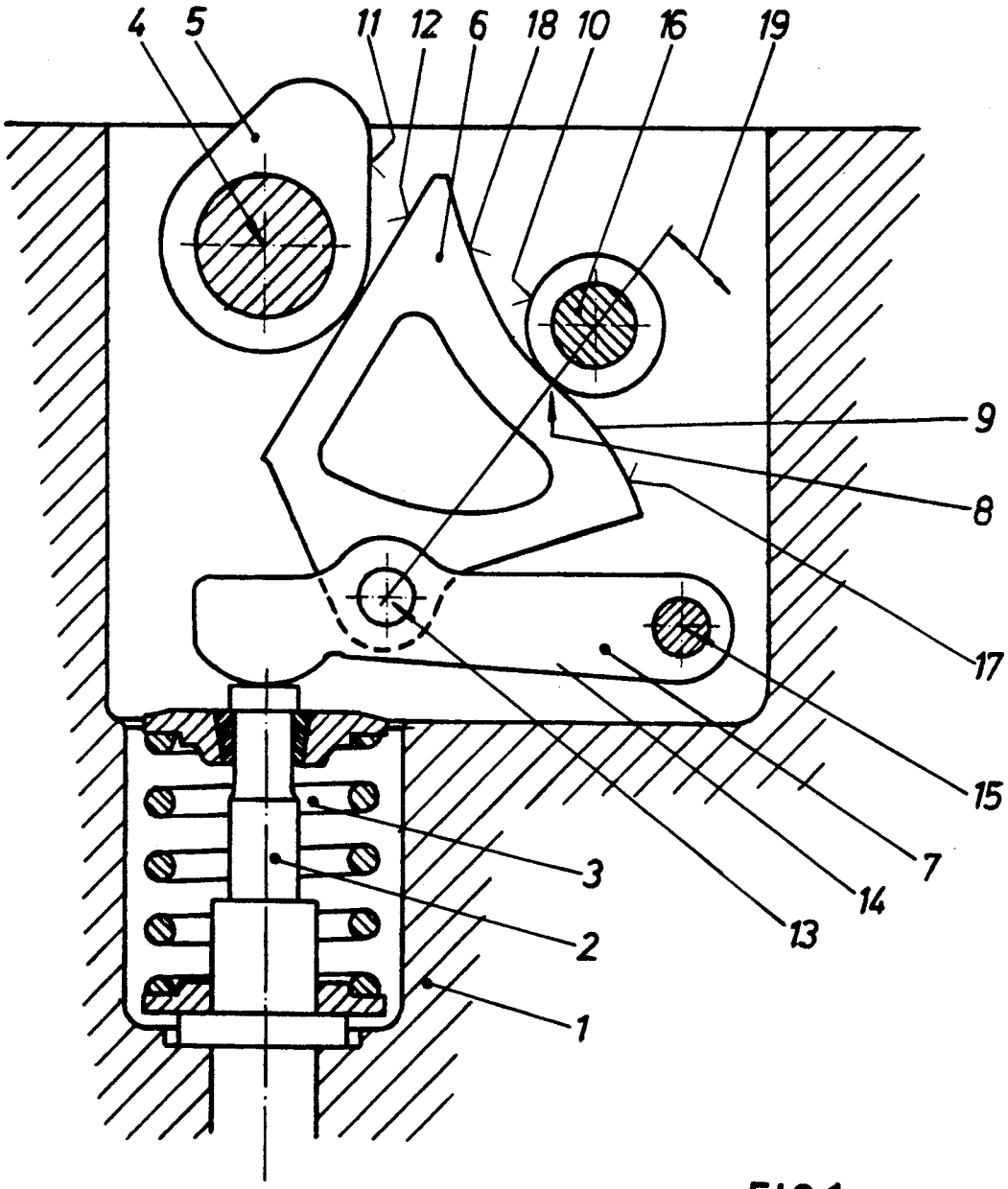
FIG. 1 is a partially schematic cross-sectional view of a first embodiment of a valve operating apparatus constructed in accordance with the present invention.

All the drawings show the case 1 with the stem 2 of a valve (not shown) and a valve spring 3 located on a stem 2. In all the embodiments the valve is driven by a cam 5 having a rotational axis 4 which, like the case 1, is part of a four-member gear, whose other parts are formed by an intermediate member 6 and a driven member 7. Furthermore, in all the embodiments, the intermediate member 6 is supported on the case 1 by a curve joint 8. The curve joint has a curve 9 on the intermediate member and a curve 10 supported on the case and which is formed in all embodiments by a cylindrical surface, for example, a bolt located in the case 1, a roll, etc. In a similar manner, in all the embodiments the cam 5 with the intermediate member 6 forms a curve joint, which is formed by the control curve 11 of cam 5 and by, for example, a planar surface 12 on the intermediate member 6.

In FIG. 1, the intermediate member 6 is connected via a pivot joint 13 to the driven member 7. In addition, the driven member 7, constructed as a drag lever 14, is supported by a pivot joint 15 on the case 1. The end of the drag lever 14 remote from the pivot joint 15 acts on the valve stem 2.

The movement of the cam 5 is transferred by the control curve 11 to the intermediate member 6, which pivots about the pivot joint 13 and is simultaneously supported on the cylindrical surface 10 of the bolt 16. This support leads to a pivoting movement of the drag lever 14 about the pivot joint 15, which is finally transmitted as a lifting movement of the valve stem 2.

The curve 9 on intermediate member 6 has two portions, whereof one portion forms a locking device (for the load-free area). This curve portion forms an arc with the pivot joint 13 as the center. For as long as the portion 17 is in operative connection with the cylindrical surface 10, no valve lift takes place.

Curve 9 also has a curve portion 18, which brings about the valve lift. By adjusting the bolt 16 or cylindrical surface 10 on an arc concentric to the pivot joint 13 in the direction of the double arrow 19, it is possible to set valve opening times and valve lift.

As shown in FIG. 1, the intermediate member 6 is essentially constructed in triangular form, with one side forming the curve 12 cooperating with the cam 5 and the other side one curve of curve joint 9, while the third side has the pivot joint 13 connecting the intermediate member 6 to the driven member 7.

Figure 2:
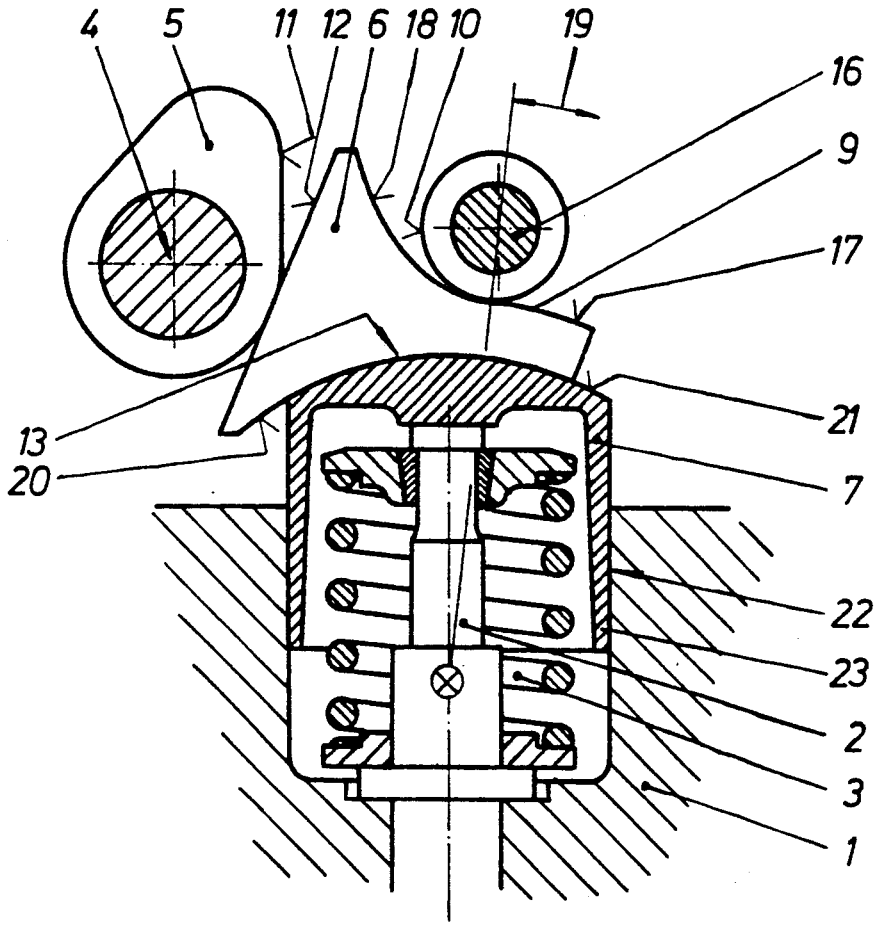
FIG. 2 is a partially schematic cross-sectional view of a second embodiment of a valve operating apparatus constructed in accordance with the present invention.

In the embodiment according to FIG. 2, the intermediate member 6 is once again triangular. The curve joint between the cam 5 and the intermediate member 6 is designed in the same way as in the embodiment according to FIG. 1. The intermediate member 6 is once again supported on the case by the cylindrical surface 10 of the bolt 16. Moreover, between the intermediate member 6 and the driven member 7 is provided a pivot joint 13, but it is in this case constructed in a different way from the embodiment according to FIG. 1. It namely comprises a cylindrical surface 20 on one side of the triangular intermediate member 6 and a cylindrical surface 21 on the driven member 7. A spherical surface can be provided in place of the cylindrical surface on the driven member 7. The latter is supported by a slider joint 22 on the case 1. For this purpose, the driven member is constructed as a cup tappet 23, which engages over the outer end of the valve stem 2 and is located in a sliding guide on the case 1.

With the cylindrical surface 10, the intermediate member 6 once again forms a curve joint and, for this purpose, has the curve 9 with the portion 17 forming the locking device, as well as the control portion 18. Here again, the portion 17, forming the locking device, passes in an arcuate manner with the pivot center of the pivot joint 13 as the center. The modification to the valve opening times and the valve lift again takes place by adjusting the bolt 16 on an arch 19, whose center once again coincides with the pivot center of the pivot joint 13.

Figure 3:
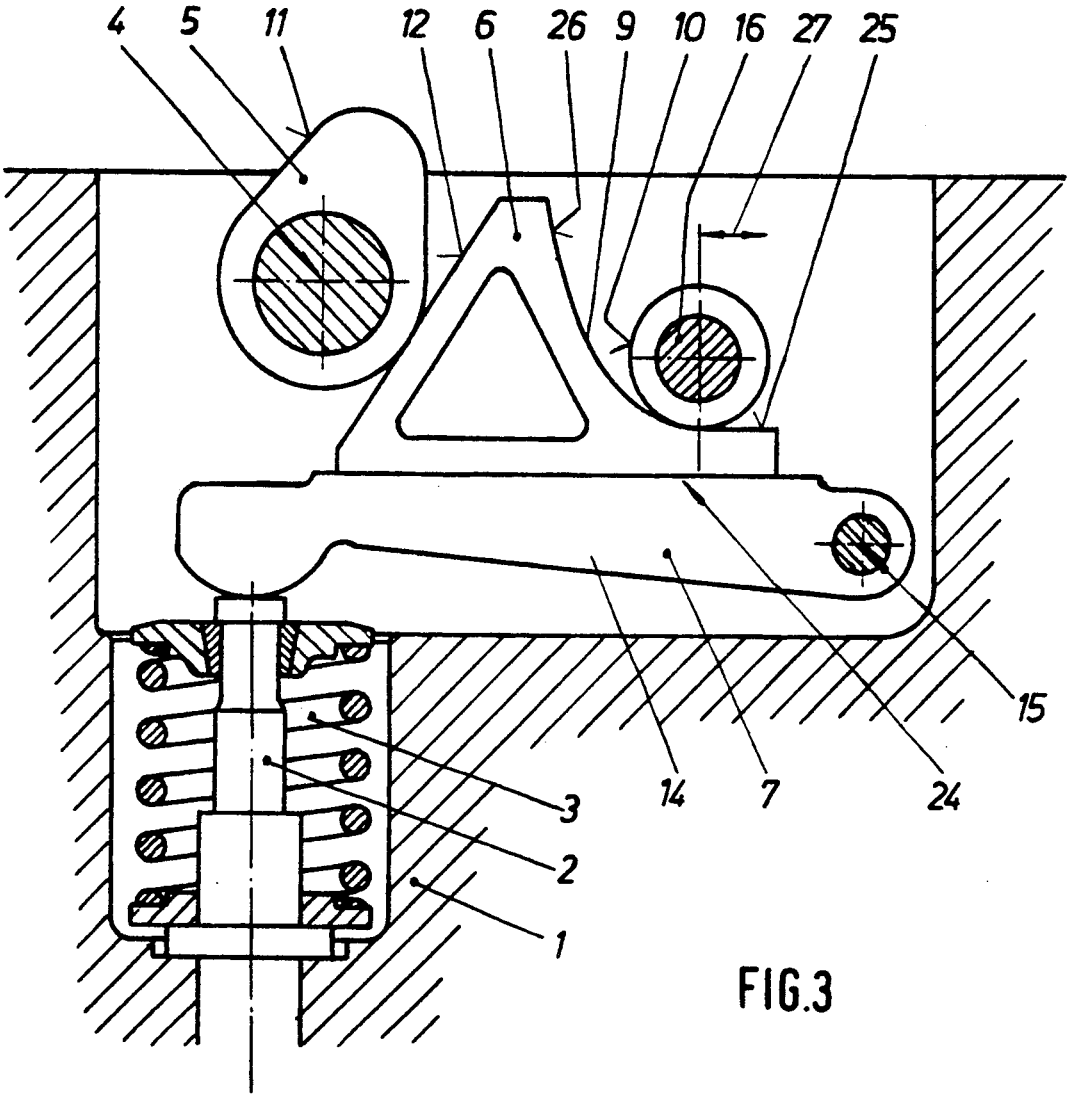
FIG. 3 is a partially schematic cross-sectional view of a further embodiment of a valve operating apparatus constructed in accordance with the present invention.

The embodiment according to FIG. 3 once again has a triangular intermediate member 6, but unlike in the aforementioned embodiments it is connected to the drive member 7 by a slider joint 24 formed by planar sliding faces on the intermediate member 6 and on the driven member 7. The driven member 7 is once again supported by a pivot joint 15 on the case 1 and also acts as a drag lever 14.

The curve 9 on the intermediate member 6, cooperating with the cylindrical surface 10 of the bolt 16, has a linear portion 15 and a curved portion 26. As a result of the linear adjustment of the bolts 16 in the direction of the double arrow 27, the effective length of the linear portion 25 of the curve 9 and, therefore, the valve opening times and the valve lift are determined.

Figure 4:
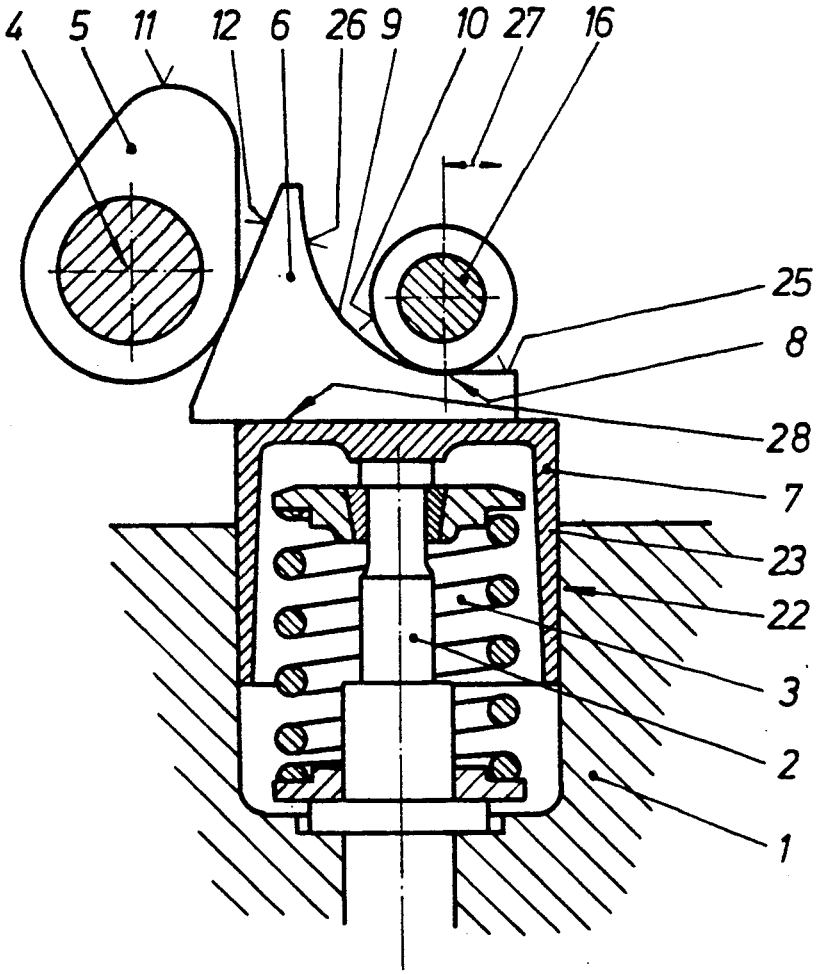
FIG. 4 is a partially schematic cross-sectional view of a still further embodiment of a valve operating apparatus constructed in accordance with the present invention.

In the embodiment according to FIG. 4, a triangular intermediate member 6, between the latter and the driven member 7, is once again provided with a slider joint 28 formed by linear sliding faces between the two members. The driven member 7, in a modification of FIG. 3 and similar to FIG. 2, is constructed as a cup tappet 23 engageable over the upper end of the valve stem 2 with the valve spring 3. The curve 9, forming part of the curve joint 8 between the intermediate member 6 and the case i, has a linear portion 25 as a locking device and a control portion 26. Here again the valve opening time and the valve lift are controlled by linear adjustment of bolts 16 in accordance with the double arrow 27.

In place of the adjustment of the bolt 16 for modifying the valve lift curve described relative to all of the embodiments, it is naturally possible in an equivalent manner to carry out the control by modifying the position of the pivot joint 4 or the cam 5.

We claim:

1. Apparatus for operating valves of an internal combustion engine, the apparatus comprising a four member rotating gear means including a variable valve lift curve, a cam connected to a case of the engine so as to be rotatable along a rotational axis and driven by a crankshaft of the engine, an intermediate member operated by the cam, a curve joint, and a driven member, first joint means for supporting said driven member on the case, and second joint means for directly connecting the driven member to the intermediate member and transferring movement to a valve of the engine, wherein said curve joint includes a first curve surface located on the intermediate member and a second curve surface supported on the case, said first curve surface has a first surface portion forming a locking device and a control portion and wherein means are provided for adjusting one of a position of the second curve surface and a position of the rotational axis of the cam during operation of the engine.

2. Apparatus according to claim 1, wherein the second curve surface is formed by a cylindrical surface.

3. Apparatus according to one of claims 1 or 2, wherein the first and second joint means includes a pivot joint.

4. Apparatus for operating valves of an internal combustion engine, the apparatus comprising a multimember rotary gear means including a rotary cam connected to a case of the engine so as to be rotatable about a rotational axis and driven by a crankshaft of the engine, an intermediate member directly operated by the cam, a curve joint, and a driven member, first joint means for supporting said driven member on the case, and second joint means for directly connecting the driven member to the intermediate member and transferring movement to a valve of the engine, wherein said curve joint includes a first curve surface located on the intermediate member and a second curve surface supported on the case, said first curve surface has a first surface portion forming a locking device and a control portion, means are provided for adjusting one of a position of the second curve surface and a position of the rotational axis of the cam during operation of the engine, and wherein the second joint means includes a pivot joint and the first joint means includes a slider joint.

5. Apparatus according to claim 3, wherein said first surface portion is formed by an arc having a center coincidental with a pivot center of the pivot joint of said second joint means.

6. Apparatus according to claim 3, wherein the second curve surface is adjustable in such a manner that a contact point with the first surface portion moves as a center on an arc with a pivot center of the pivot joint of said second joint mean.

7. Apparatus according to cliam 3, wherein the second curve surface is adjustable as a center on an arc with a pivot center of the pivot joint of said second joint means.

8. Apparatus for operating valves of an internal combustion engine, the apparatus comprising a multimember rotary gear means including a rotary cam connected to a case of the engine so as to be rotatable about a rotational axis and driven by a crankshaft of the engine, an intermediate member operated by the cam, a curve joint, and a driven member, first joint means for supporting said driven member on he case, and second joint means for operatively connecting the driven member to the intermediate member and transferring movement to a valve of the engine, wherein said curve joint includes a first curve surface located on the intermediate member and a second curve surface supported on the case, said first curve surface has a first surface portion forming a locking device and a control portion, means are provided for adjusting one of a position of the second curve surface and a position of the rotational axis of the cam during operation of the engine, and wherein said second joint means is constructed as a slider joint and said first joint means is constructed as a pivot joint.

9. Apparatus for operating valves of an internal combustion engine, the apparatus comprising a multimember rotary gear means including a rotary cam connected to a case of the engine so as to be rotatable about a rotational axis and driven by a crankshaft of the engine, an intermediate member operated by the cam, a curve joint, and a driven member, first joint means for supporting said driven member on the case, and second joint means for operatively connecting the driven member to the intermediate member and transferring movement to a valve of the engine, wherein said curve joint includes a first curve surface located on the intermediate member and a second curve surface supported on the case, said first curve surface has a first surface portion forming a locking device and a control portion, means are provided for adjusting one of a position of the second curve surface and a position of the rotational axis of the cam during operation of the engine, and wherein said first and second joint means each includes a slider joint.

10. Apparatus according to claim 8, wherein the first surface portion is formed by a plane parallel to a plane of the slider joint of the second joint means.

11. Apparatus according to claim 10, wherein the second curve surface is adjustable in such a manner that a contact point with the first surface portion moves parallel to the plane of the slider joint.

12. Apparatus according to claim 11, wherein the second curve surface is adjustable parallel to the plane of the slider joint.

13. Apparatus according to one of claim 1 or 2, wherein the intermediate member is substantially triangular, a first side of said intermediate member forms part of said curve joint with the cam, a second side forms part of the first joint means, and a third side forms part of the second joint means.

14. Apparatus according to claim 3, wherein the driven member includes a lever fashioned as one of a drag lever and a rocking lever.

15. Apparatus according to claims 4 or 9 wherein the driven member is constructed as a cup tappet engageable over an end of a valve stem of the valve of the engine.

16. Apparatus according to one of 4, 8 or 9, wherein said means for adjusting is disposed at one of the gear members and between the driven member and a valve stem of the valve of the engine.

17. Apparatus according to claims 4, 8 or 9, wherein the second curve surface is formed by a cylindrical surface.

18. Apparatus according to claim 9, wherein the second curve surface is adjustable in such a manner that a contact point with the first surface portion moves parallel to a plane of the slider joint.

19. Apparatus according to claim 9, wherein the second curve surface is adjustable parallel to a plane of the slider joint.

20. Apparatus according to one of claims 4, 8 or 9, wherein the intermediate member is substantially triangular, a first side of said intermediate member forms a part of said curve joint with said cam, a second side forms a part of the first curve joint means, and a third side forms a part of the second joint means.

21. Apparatus according to claim 8, wherein the driven member includes a lever fashioned as one of a drag lever and a rocking lever.

22. Apparatus according to claim 9, wherein the first surface portion is formed by a plane parallel to a plane of the second joint means.

* * * * *